US008191312B2

(12) United States Patent
Wang

(10) Patent No.: US 8,191,312 B2
(45) Date of Patent: Jun. 5, 2012

(54) AUTOMATIC REVOLVING DOOR HAVING FOLDABLE ROTARY WINGS

(76) Inventor: Bok Kwon Wang, Gyeonggi-do (KR)

( * ) Notice: Subject to any disclaimer, the term of this patent is extended or adjusted under 35 U.S.C. 154(b) by 757 days.

(21) Appl. No.: 11/989,662

(22) PCT Filed: May 24, 2006

(86) PCT No.: PCT/KR2006/001952

§ 371 (c)(1),
(2), (4) Date: Jan. 29, 2008

(87) PCT Pub. No.: WO2007/013727

PCT Pub. Date: Feb. 1, 2007

(65) Prior Publication Data

US 2009/0293362 A1 Dec. 3, 2009

(30) Foreign Application Priority Data

Jul. 29, 2005 (KR) ..... 10-2005-0069334

(51) Int. Cl.
*E05D 15/02* (2006.01)

(52) U.S. Cl. ..... 49/44; 49/42; 49/45

(58) Field of Classification Search ..... 49/42, 43, 49/44, 45, 381, 396

See application file for complete search history.

(56) References Cited

U.S. PATENT DOCUMENTS

| | | | | | |
|---|---|---|---|---|---|
| 588,620 | A | * | 8/1897 | Van Kennel | 49/45 |
| 1,202,801 | A | * | 10/1916 | Carter | 49/45 |
| 1,421,941 | A | * | 7/1922 | Hayes | 49/396 |
| 2,523,980 | A | * | 9/1950 | Whiteford | 49/44 |
| 4,341,165 | A | * | 7/1982 | Calandritti et al. | 109/8 |
| 4,557,073 | A | * | 12/1985 | Sandling | 49/41 |
| 4,565,030 | A | * | 1/1986 | LaSance | 49/44 |
| 4,691,958 | A | * | 9/1987 | Miller | 296/146.1 |
| 5,634,295 | A | * | 6/1997 | Bunzl | 49/45 |

FOREIGN PATENT DOCUMENTS

| | | | |
|---|---|---|---|
| EP | 0606193 | A1 | 7/1994 |
| GB | 167013 | A | 8/1921 |
| JP | 09-324583 | A | 12/1997 |
| JP | 2002-295122 | A | 10/2002 |

* cited by examiner

*Primary Examiner* — Gregory J Strimbu

(74) *Attorney, Agent, or Firm* — Park & Associates IP Law, P.C.

(57) ABSTRACT

An automatic revolving door having a plurality of foldable revolving wings, in which each revolving wing is disposed at a lower side of a horizontal plate which is driven by a driving motor, and an upper outer side of each revolving wing is coupled with hinge to the horizontal plate, and an upper inner side of each revolving wing is slidably coupled to a cross bar attached to the horizontal plate, and each revolving wing is pivotally moveable toward outer wall members of the door to provide a wide opening between the outer wall members.

2 Claims, 6 Drawing Sheets

[Fig. 1]

[Fig. 3]
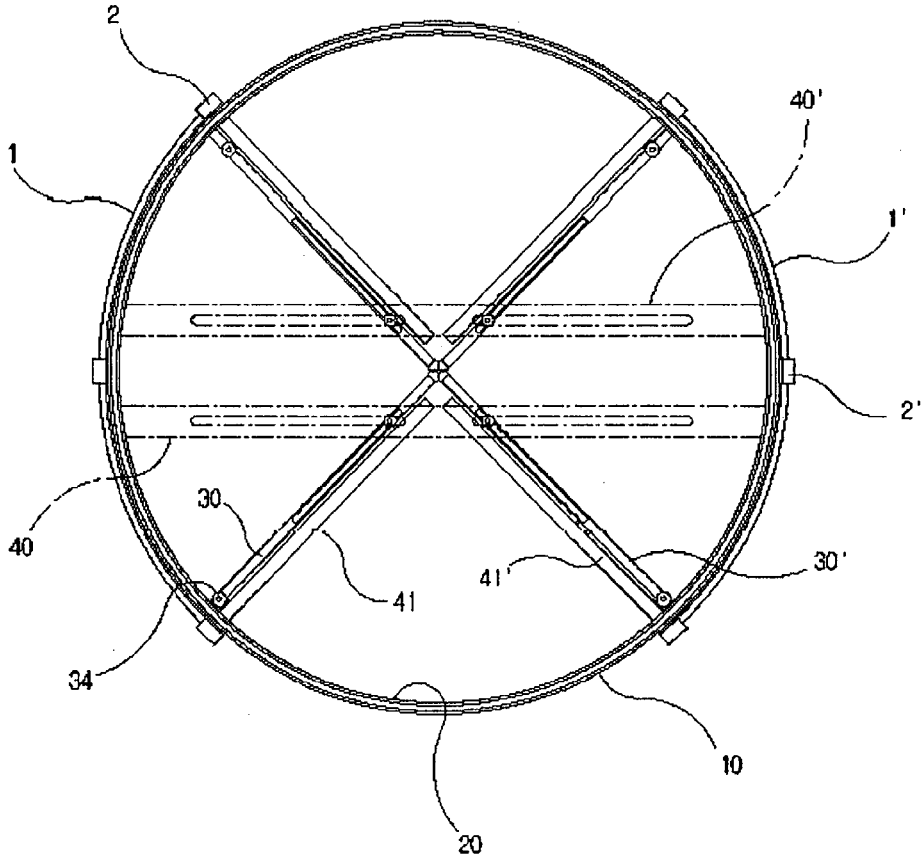
[Fig. 4]
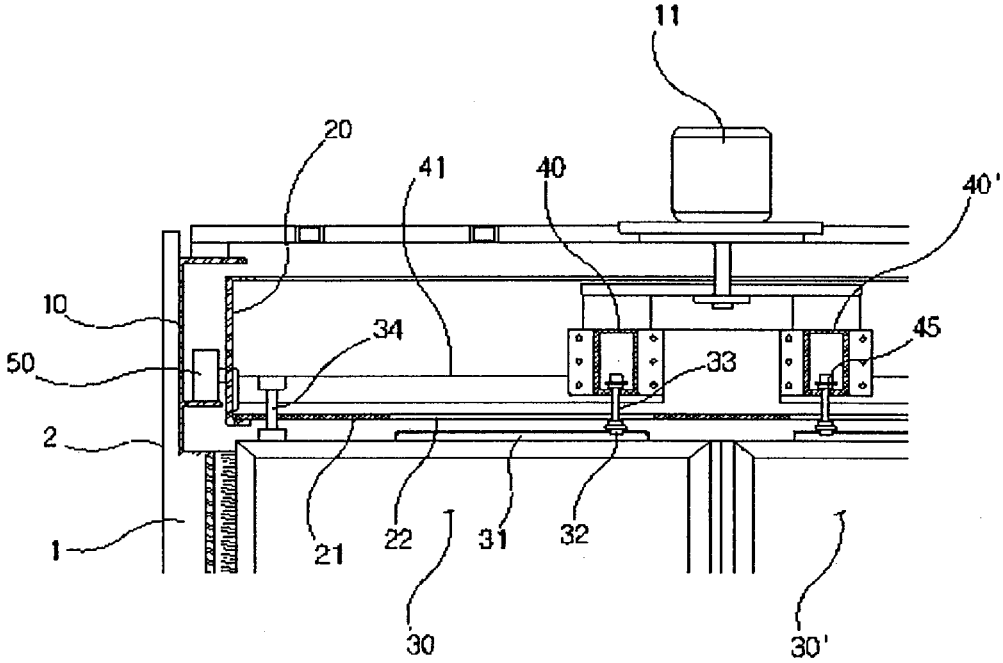

[Fig. 5]
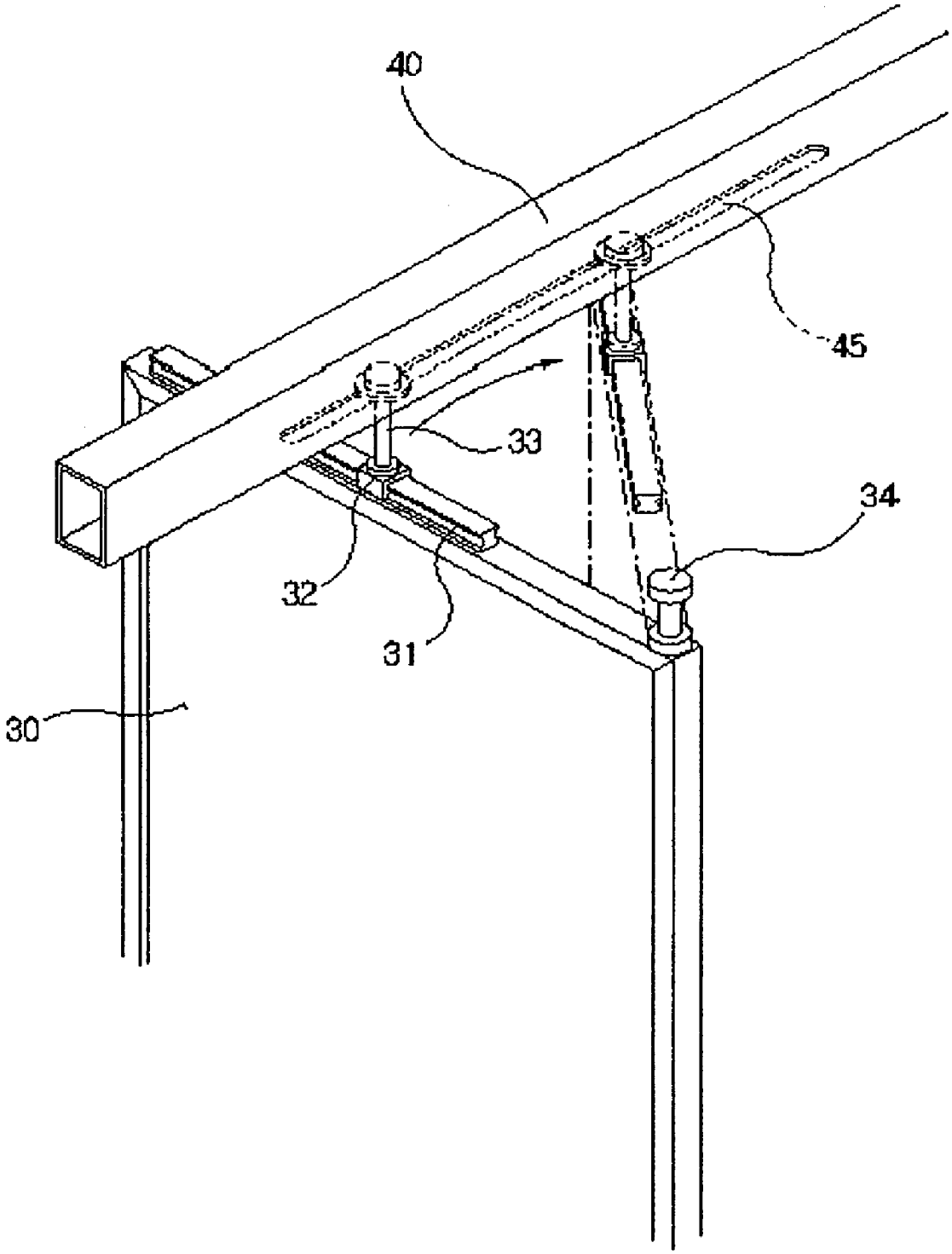

[Fig. 6]
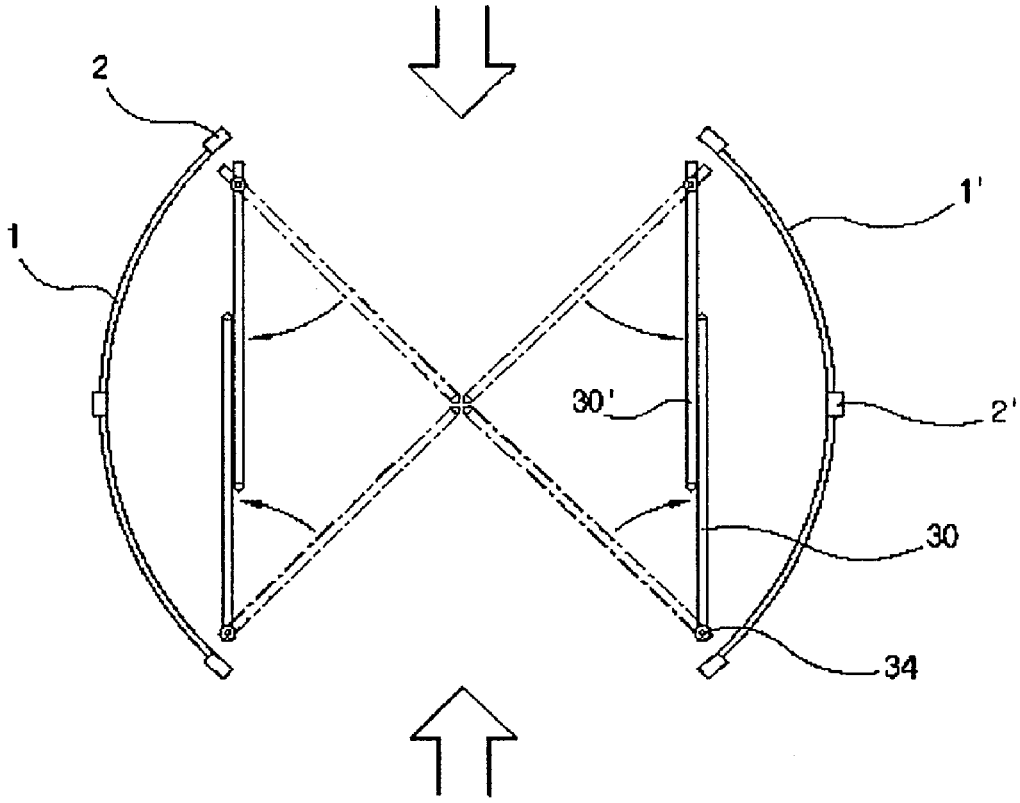
[Fig. 7]
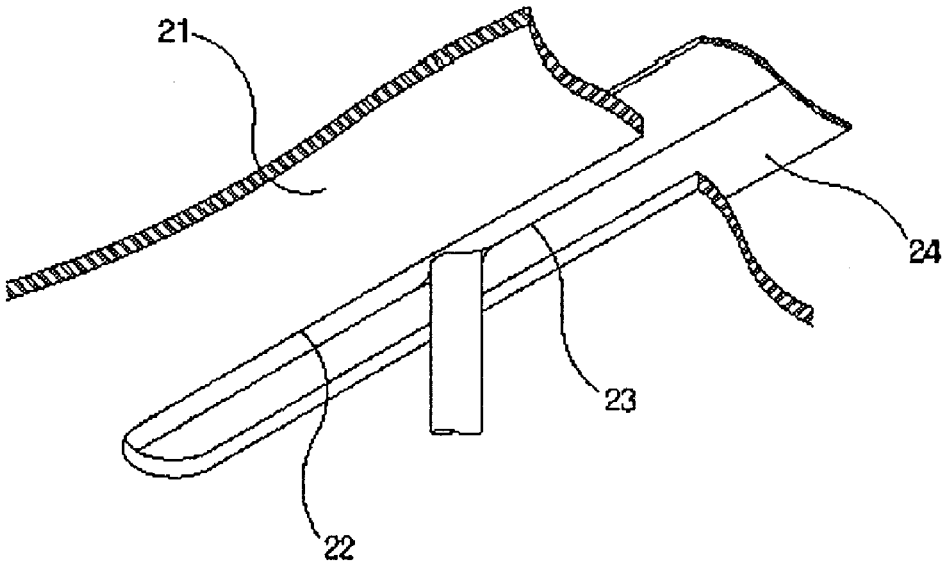

AUTOMATIC REVOLVING DOOR HAVING FOLDABLE ROTARY WINGS

CROSS REFERENCE TO RELATED APPLICATION

This is a National Stage of International Application PCT/KR2006/001952, filed 24 May 2006, which claims the benefit of Application No. 10-2005-0069334, filed in Korea on 29 Jul. 2005, the disclosures of which Applications are incorporated by reference herein.

FIELD OF THE INVENTION

The present invention relates to a revolving door installed at an entrance of a building, and in particular to an automatic revolving door having a plurality of revolving wings, in which the revolving wings are hinged at a horizontal plate to pivotally move toward a transparent wall member so that a wider inner passage area is obtained by unfolding the revolving wings towards the transparent wall member. The term "unfold" (or "unfolding", "unforlable" or similar) used in this disclosure refers to the movement of each revolving wing from the initial blocking position to an open or unblocking position.

BACKGROUND OF THE INVENTION

Generally, a revolving door is often installed at an entrance of a building, and enables people and various things to pass through the revolving door.

In a construction of a conventional revolving door, a plurality of revolving wings 101 and 101' are installed at a vertical revolving shaft 100 as shown in FIG. 9, with a transparent wall member 103 being installed at an outer side of the revolving wings 101 and 101', with the transparent wall member 103 having entrances 102 and 102'.

An additional opening and closing door 104 is installed at a side or at both sides of the transparent wall member 103, so that some passenger or a lengthy thing passes.

The conventional revolving door is designed so that a user pushes a revolving wing and allows the door to rotate, whereby the user can pass the revolving door.

Recently, a driving force device is installed at the revolving door, and a detection sensor is installed at an entrance. With the above construction, when a user comes closer to the door, the detection sensor detects the movement of the user and applies electric power to the driving force device, and the connected revolving shaft is automatically rotated, so that the user can easily passes without physically pushing the door.

In particular, the conventional revolving door and automatic revolving doors have the problems that a user's thing or clothes may be caught between the end of the revolving door and the transparent wall member. In the case that it is supposed to pass a long thing, such things cannot pass the revolving door based on the installation angle of the revolving wings.

Each revolving wing is designed with a revolving folding structure at one side or both sides of the revolving shaft. With this structure, when a certain safety accident occurs, it is possible to quickly cope with the accident by folding a corresponding wing. In the case that a long thing is intended to pass through the revolving door, a corresponding revolving wing is folded in one side, so that a certain passage space is obtained.

However, the automatic revolving door and the folding structure of the revolving wing are folded in parallel with respect to the center revolving shaft. Even when the revolving wings are folded, since the revolving wings and the center revolving shaft hinged are positioned at the center of the revolving door, it is impossible to obtain a desired wide passage space.

Namely, the conventional revolving door or automatic revolving door commonly has a number of revolving wings at the vertical center revolving shaft. In the case that the revolving wings are folded so as to obtain a desired wide passage space or a safety, the revolving wings are folded from the center revolving shaft, so that it is impossible to obtain wide passage spaces because the center revolving shaft and revolving wings still remain at the inner center of the revolving door.

In the case that the user uses the revolving door together with companion or VIP or entertainment star uses the door, only a singly user should pass through the door, so that a security problem occurs. In a place in which vehicles are exhibited or large size products are exhibited, since the vehicles and large size things do not enter the door, a large size opening and closing door should be additionally installed.

BRIEF SUMMARY OF THE INVENTION

Accordingly, it is an object of the present invention to overcome the problems encountered in the conventional art.

It is another object of the present invention to provide an automatic revolving door having a plurality of revolving wings, in which each revolving wing is engaged at a lower side of a horizontal plate driven by a driving motor with the revolving wings being displaced at regular angles, and an upper outer side of the revolving wing is hinged at an outer end of the support of the horizontal plate, and the upper inner side of the revolving wing is slidable at a lower side of the cross bar of the horizontal plate, and each revolving wing is unfolded in the direction of the outer wall member with respect to the outer front end. With the above construction, because a conventional center rotary shaft is not provided, the function of the revolving door is improved. When it is needed to open the passage of the revolving door, the revolving wing is folded in the inward direction of the wall member, so that the passage of the revolving door is fully opened. Therefore, a VIP who requires an enhanced security and a private entertainer and his companion can freely pass there-through. In addition, vehicles or big size things like furniture can pass through the revolving door, so that convenience is enhanced. It is possible to freely pass various things without providing additional opening and closing doors. A larger number of people can concurrently enter the door, so that efficiency is enhanced.

BRIEF DESCRIPTION OF THE DRAWINGS

FIG. 3 is a plane view illustrating an automatic revolving door according to the present invention;

FIG. 4 is a lateral cross sectional view illustrating a major part of an automatic revolving door according to the present invention;

FIG. 5 is a perspective view illustrating an opening and closing operation of a revolving wing of an automatic revolving door according to the present invention;

FIG. 6 is a plane view illustrating an opened revolving wing of the automatic revolving door according to the present invention;

FIGS. 7 and 8 are views illustrating a guide hole of an automatic revolving door according to the present invention, of which:

FIG. 7 is an enlarged cross sectional illustrating an elastic seat having a cut line at a guide hole of an upper plate; and FIG. 8 is an enlarged cross sectional illustrating a state that a sliding unit and a movable plate are together installed at an upper side of a guide hole of an upper plate.

DETAILED DESCRIPTION OF THE INVENTION

The preferred embodiments of the present invention will be described with reference to the accompanying drawings.

Figure 1:
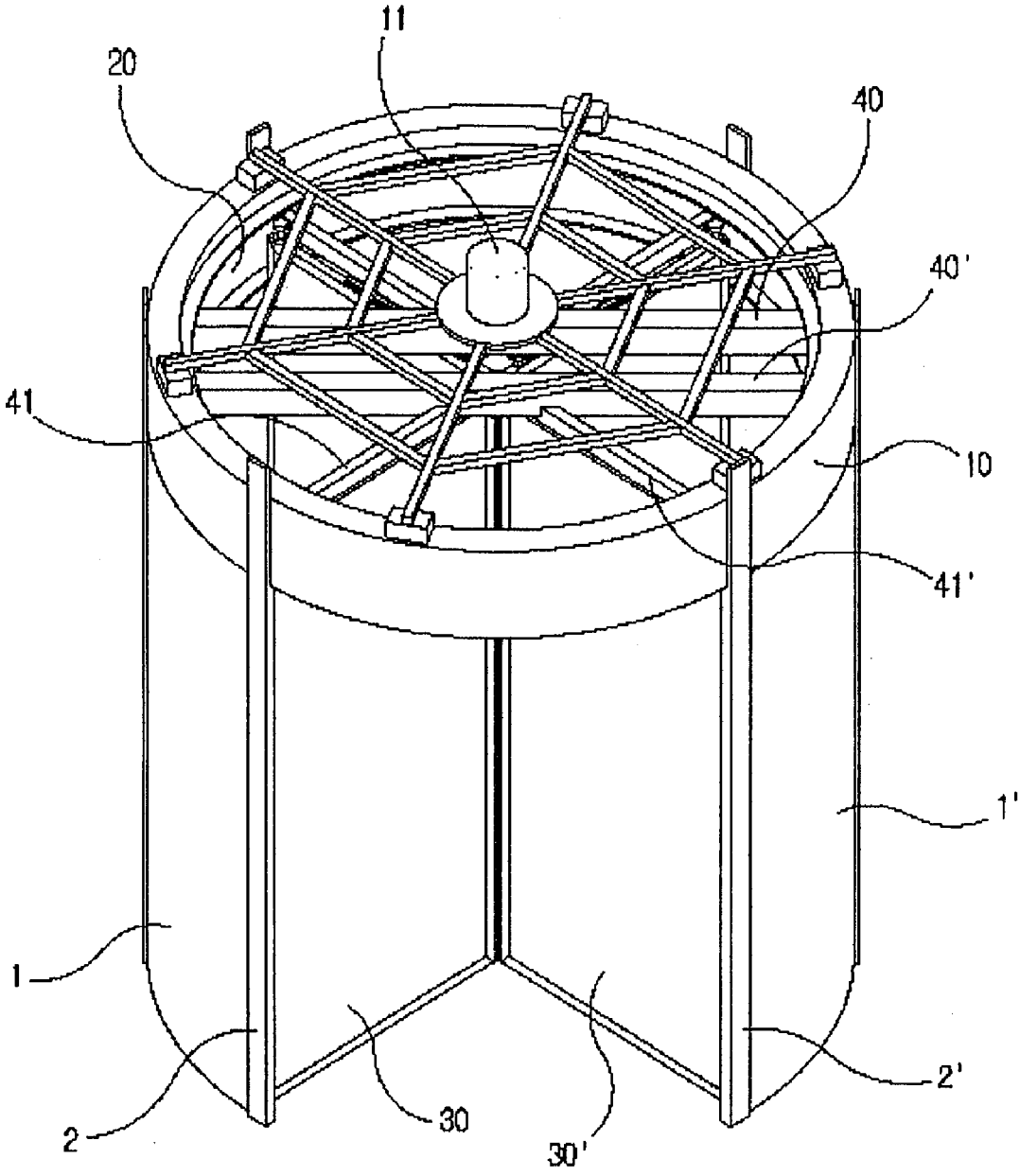
FIG. 1 is a perspective view illustrating an automatic revolving door according to the present invention.
Figure 2:
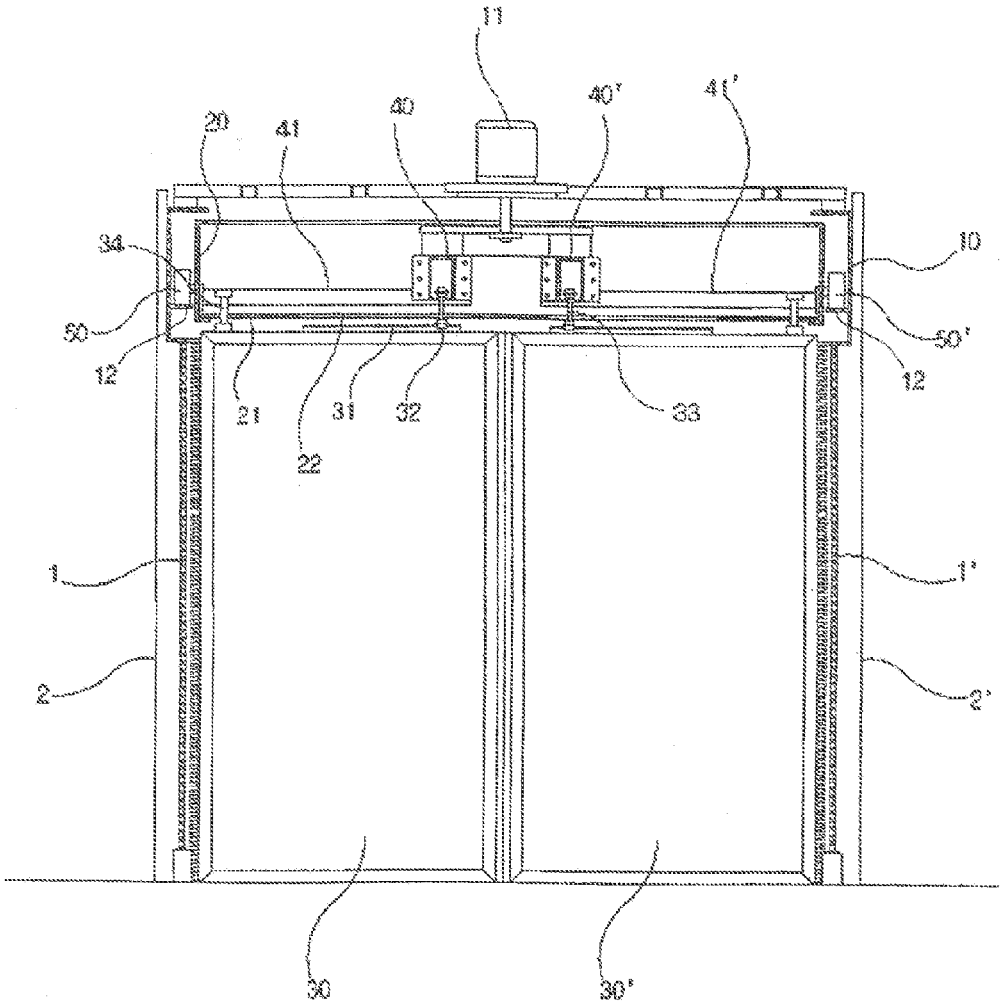
FIG. 2 is a lateral cross sectional view illustrating an automatic revolving door according to the present invention.

FIG. 1 is a perspective view illustrating an automatic revolving door according to the present invention, and FIG. 2 is a lateral cross sectional view illustrating an automatic revolving door according to the present invention, and FIG. 3 is a plane view illustrating an automatic revolving door according to the present invention.

An outer body 10 is installed at the upper side of vertical frames 2 and 2' having transparent wall members 1 and 1'. An inner body 20 having a horizontal plate 21 is installed at an inner lower side of the outer body 10. A plurality of separated revolving wings 30 and 30' are installed at the lower side of the horizontal plate 21. The inner body 20 and the revolving wings 30 and 30' are concurrently rotated by a rotational driving force of the driving motor 11 installed at an upper side of the outer body 10. An upper side of each revolving wing 30 and 30' is rotatably fixed with the hinge shaft 34 at an inside area of the inner body 20. Another upper side of each revolving wing is slidably installed at the crossbars 40 and 40' crossing the inner body 20.

A plurality of rotation rollers 50 and 50' engaged at the outer side of the inner body 20 are supported by the support protrusion 12 protruded from the inner side of the outer body 10, and the revolving wings 30 and 30' are unfolded toward the transparent wall members 1 and 1' along the crossbars 40 and 40' with respect to the hinge shaft 34.

The support members 41 and 41' of which ends are fixed at the inner wall of the inner body 20 are installed at the lower sides of the crossbars 40 and 40' in the crossing shape, and the hinge shafts 34 of the revolving wings 30 and 30' are inserted into the outer sides of the support members 41 and 41'. A door rail 31 is formed at the upper sides of the revolving wings 30 and 30', and a moving rod 33 installed at an upper side of the slider 32 is movably coupled at the crossbars 40 and 40'. With the above construction, the revolving wings 30 and 30' can be unfolded toward the transparent wall members 1 and 1' with respect to the hinge shaft 34 by the sliding movement of the slider 32 and the moving rod 33. See FIG. 6.

The inner side of the inner body 20 is finished with the horizontal plate on the lower side of the inner body 20. A guide elongated hole 22 is formed so that the moving rod 33 of the slider 32 reciprocates. A rubber seat 24 having a cut line 23 is provided in the guide elongated hole 22. A cover plate 25 (FIG. 8) movable with the moving rod 33 is provided on an upper side of the guide elongated hole 22, so that the interior of the inner body 20 is not seen from the lower side of the horizontal plate 21 through the guide elongated hole 22.

In the drawings, reference numeral 45 represents a slit of the crossbar.

The operation of the revolving door having unfoldable revolving wings according to the present invention will be described with reference to the accompanying drawings.

The basic structure of the automatic revolving door according to the present invention is provided with the vertical frames 2 and 2' spaced at regular intervals, and transparent wall members 1 and 1' formed in a circular shape between the vertical frames 2 and 2'. The entrance is provided between the vertical frames 2 and 2' where the transparent wall members 1 and 1' are not present.

The transparent wall members 1 and 1' are formed of tempered glass or high strength synthetic resin.

As shown in FIG. 4, the outer body 10 including various driving elements and operation parts is provided at the upper sides of the transparent wall members 1 and 1' and the vertical frames 2 and 2'. The driving motor 11 is engaged at the inner side or the upper side of the outer body 10 so as to drive the revolving wings 30 and 30'.

The inner body 20 is provided at the inner side of the outer body 10 and is rotated together with the revolving wings 30 and 30' having the hinged engagement of the revolving wings 30 and 30'.

A plurality of rotating rollers 50 and 50' are installed at the outer surface of the inner body 20 and are supported by the support protrusion 12 protruded from the inner side of the outer body 10. As the driving motor 11 operates, the inner body 20 is stably supported by the support protrusion 2 of the outer body 10 for thereby implementing a stable rotation.

In particular, the revolving wings 30 and 30' hinge-fixed at the inner body 20 are unfold-rotated from the inner body 20 to the transparent wall members 1 and 1'.

The hinge shaft 34 and the door rail 31 are provided at the upper sides of the revolving wings 30 and 30', and the revolving wings 30 and 30' hinge-engaged with the inner wall of the inner body 20 are rotated to unfold toward the transparent wall members 1 and 1'.

The door rail 31 formed at the upper ends of the revolving wings 30 and 30' allows the stable support and unfolding of the revolving wings 30 and 30' supported by the hinge shaft 34.

The slider 32 inserted into the door rail 31 is provided with a moving rod 33 in the upward direction, and the upper end of the moving rod 33 is slidably inserted into the lower sides of the crossbars 40 and 40' which cross the inner body 20.

Therefore, when a rotational force is applied to the revolving wings 30 and 30' so as to fully open the revolving wings 30 and 30' so that the vehicles or large size things or a number of people can pass concurrently, as shown in FIG. 5, the moving rod 33 slides along the slit hole 45 of the crossbars 40 and 40', and the slider 32 of the lower side of the moving rod 33 slides along the door rail 31, so that the door rail 31 and the removing wings 30 and 30' are rotated and unfolded with respect to the hinge shaft 34 based on the fixed position of the crossbars 40 and 40'.

The hinge shaft 34 may be directly fixed at the inner side of the inner body 20. It is arranged diagonally from the centers of the crossbars 40 and 40' so as to enhance the support force, with each end of the same being fixed at the inner wall of the inner body 20 and being inserted into the ends of the support members 41 and 41', so that the weight of the revolving wings 30 and 30' is transferred to the support members 41 and 41', whereby it is possible to maintain a stable support force and installation state.

Therefore, when each revolving wing 30 and 30' positioned diagonally from each other and rotating concurrently is rotated-unfolded toward the transparent wall members 1 and 1', as shown in FIG. 6, the inner side of the revolving door is fully opened, so that many people can pass together and vehicles or large size furniture can pass through the door.

When the fully unfolded revolving wings 30 and 30' are intended to return to their original positions, the slider 32 is moved toward the center of the crossbars 40 and 40' along the door rail 31, so that the revolving wings 30 and 30' are naturally crossed from each other and return to their original positions.

The users may directly perform the unfolded and returning forces of the revolving wings 30 and 30'. A certain actuator or emerging unit may be provided, so that the automatic unfolding and returning procedures of the revolving wings 30 and 30' may be performed.

Since the inner side of the inner body 20 is exposed to outside, the outer look is bad. An upper plate 21 is formed at the bottom of the inner body 20, so that the inner side of the same is hidden. A guide elongated hole 22 is formed at the upper plate 21 so that the moving rod 33 connecting the inner body 20 and the revolving wings 30 and 30' is not interfered.

Here, the number of the guide elongated holes 22 is determined based on the number of the revolving wings 30 and 30' so as to correspond with the lower side of the crossbars 40 and 40' based on an operation range of the moving rod 33. When the revolving wings 30 and 30' are folded, almost lower sides of the guide elongated hole 22 are opened downwards, so that the inner side of the inner body 20 can be seen from outside. So as to prevent the above problems, as shown in FIG. 7, a rubber seat 24 having a cut line 23 is formed at the inner side of the guide elongated hole 22, so that the moving rod 33 is moved along the cut line 23 of the rubber seat 24. With the above construction, the inner side of the upper plate 21 is not seen by the rubber seat 24.

Figure 8:
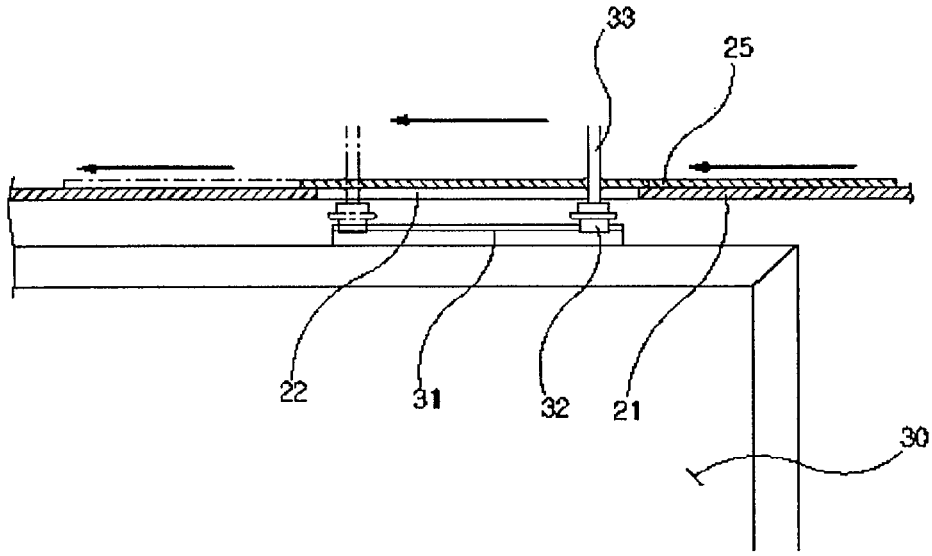
Figure 9:
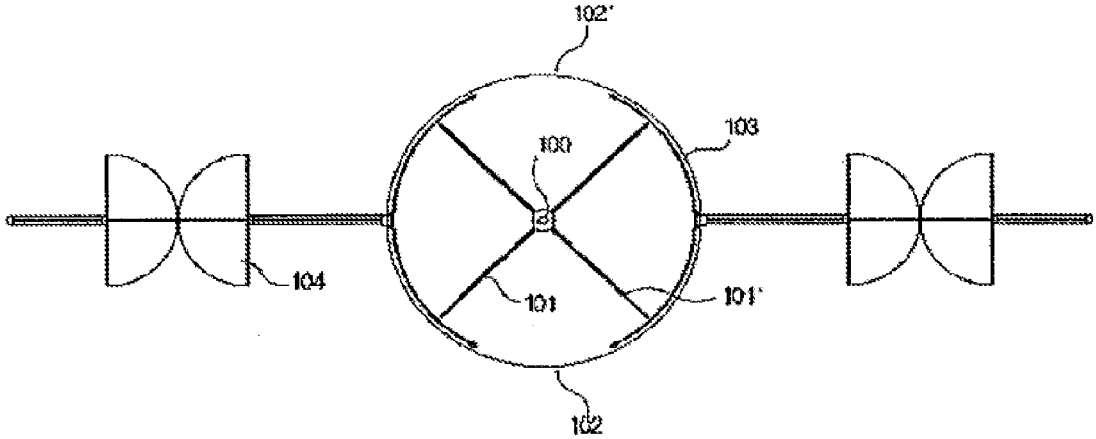
Fig. 9 (PRIOR ART)
FIG. 9 is a plane view illustrating the whole structure of the conventional automatic revolving door.

In addition, as shown in FIG. 8, a cover plate 25 having a length longer than the guide elongated hole 22 may be placed on the upper surface of the guide elongated hole 22 instead of the rubber seat 24. The moving rod 33 passes through the cover plate 25. Upon the sliding of the moving rod 33, the cover plate 25 moves. The guide elongated hole 22 may be continuously closed.

INDUSTRIAL APPLICABILITY

As described above, the automatic revolving door having a dispersion unfolding structure of a revolving wing according to the present invention is designed to satisfy the inherent functions of the revolving door without the center rotary shaft. In the case that the passage of the revolving door is opened, the revolving doors are folded inwardly and unfolded for thereby fully opening the passage of the revolving door. With the above construction, VIP or entertainment star who needs high security can enter, and the vehicles or large size furniture can enter for thereby enhancing the use of the same. The movements of various things are not interfered without providing an additional opening and closing door. Many people can concurrently enter the revolving door, so that the efficiency is maximized.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. An automatic revolving door comprising a plurality of revolving wings, an outer body with transparent wall members coupled thereto, and an inner body having a horizontal plate, the inner body and the revolving wings concurrently rotated by a rotational driving force from a driving motor, the inner body further including first and second crossbars extending across the inner body in parallel relation to each other, the first and second crossbars and said horizontal plate rotatable together with the inner body upon rotation of the driving motor, and each of the revolving wings having a radially outer end pivotally fixed by a hinge shaft to said horizontal plate of the inner body and a radially inner end slidably coupled to a moving rod to a corresponding one of said crossbars, and a plurality of rotation rollers each disposed on an outer side of the inner body, and each of the revolving wings being rotatable about said hinge shaft of said revolving wing to pivotally move said radially inner end of said revolving wing radially outward toward a corresponding one of said transparent wall members with said moving rod of said revolving wing moving along the corresponding one of said crossbars, wherein each of said revolving wings has a door rail attached to an upper side of the revolving wing and said moving rod of said revolving wing is installed at an upper side of the door rail, wherein the horizontal plate includes a plurality of elongated guide holes, each of said moving rods being slidably disposed within a respective one of said elongated guide holes, and each said guide hole includes a rubber seat having a cut line so that an interior of the inner body is obscured from view from a lower side of the inner body through the elongated guide hole as said moving rod of said guide hole moves along said cut line.

2. The revolving door of claim 1, wherein at least one support member is attached to a lower side of one of said crossbars, and the hinge shaft of one of said revolving wings is affixed to the support member.

* * * * *